US006409834B1

(12) United States Patent
Frati

(10) Patent No.: US 6,409,834 B1
(45) Date of Patent: Jun. 25, 2002

(54) GLUING APPARATUS FOR WOOD FIBER PANEL PRODUCTION PLANTS

(75) Inventor: Luigi Frati, Mantova (IT)

(73) Assignee: C.M.P. Costruzioni Meccaniche Pomponesco S.p.A., Pomponesco (IT)

( * ) Notice: Subject to any disclaimer, the term of this patent is extended or adjusted under 35 U.S.C. 154(b) by 0 days.

(21) Appl. No.: 09/469,483

(22) Filed: Dec. 22, 1999

(30) Foreign Application Priority Data

Jan. 25, 1999 (IT) ..... MI99A0129

(51) Int. Cl.[7] ..... B05B 17/00
(52) U.S. Cl. ..... 118/303; 118/313; 156/578
(58) Field of Search ..... 118/303, 313, 118/315, 316, 317, 308, 312, 62, 418; 427/212, 213; 156/578, 547

(56) References Cited

U.S. PATENT DOCUMENTS

| | | | | |
|---|---|---|---|---|
| 4,220,426 A | | 9/1980 | Ply | 406/89 |
| 4,510,184 A | * | 4/1985 | Winkler et al. | 427/212 |
| 5,792,264 A | * | 8/1998 | Frati | 118/303 |

FOREIGN PATENT DOCUMENTS

| | | |
|---|---|---|
| DE | 1632450 | 2/1968 |
| DE | 1632450 | * 10/1975 |
| DE | 4115047 | 5/1991 |
| GB | 1055674 | 1/1967 |

* cited by examiner

*Primary Examiner*—Richard Crispino
*Assistant Examiner*—Yewebdar T Tadesse
(74) *Attorney, Agent, or Firm*—Steinberg & Raskin, P.C.

(57) ABSTRACT

The gluing apparatus (220) for plants for producing wood fibre panels by a dry method comprises a tubular body (250) and sprayer means (262) to inject a suitable liquid glue into the interior of the tubular body (250). The cross-section through the tubular body (250) encloses an area which increases in progressing from its open upstream end (253), into which the wood fibres are fed conveyed by an air stream, to its open downstream end 257). The tubular body (250) comprises a sealed outer wall (252) and an air-permeable inner wall (254) spaced from the former (242). In the outer wall (252) of the tubular body (250) there are provided a plurality of apertures distributed along this latter to enable additional air streams to be fed (through 258) into it.

15 Claims, 5 Drawing Sheets

GLUING APPARATUS FOR WOOD FIBER PANEL PRODUCTION PLANTS

FIELD OF THE INVENTION

This invention relates to a so-called gluing or resin-blending machine, ie a machine used in plants producing wood fibre panels by a dry method (in particular medium density fibreboard or MDF panels), the machine in this case blending wood fibres with a thermosetting liquid glue.

BACKGROUND OF THE INVENTION

As is well known to the expert of the art, MDF panels are produced by two types of plant, known respectively as a blow-line plant and a resin-blending or traditional plant.

The essential characteristics of a blow-line plant, shown schematically in FIG. 1, will now be described. This shows a grinder 10 which is fed with wood and steam (this feed being indicated by the arrow 12) to reduce the wood to fibres. The fibres produced in this manner leave the grinder 10 through a blow-up valve 14 mixed with steam (relative humidity 100%) and are conveyed via a line 16 to a dryer 18. A liquid glue is injected through the blow-up valve 14 (as indicated in FIG. 1 by the arrow 20) at a pressure of about 6–8 bar, so that a mixture of wood fibres and glue is fed to the dryer 18. Hot gas 26 and air 28 at ambient temperature are also fed to the dryer 18 via a fan 22 and a line 24, to dry the fibres. For this purpose the temperature within the dryer 18 can be varied from 120 to 250° C. The fibres dried in this manner are conveyed via a line 30 to a bank of cyclones 32 in which the dry fibre is separated from the steam and gas (formaldehyde) which develop during drying, the steam and gas being discharged to atmosphere, as indicated by the arrow 34.

The fibres leaving the cyclones 32, and having a moisture content varying from 2 to 10%, are fed via a mechanical conveyor 36 to a continuously operating so-called bunker weigher 38 where they are weighed out. The fibres leaving the bunker weigher 38 are conveyed to a pneumatic separator 40 the purpose of which is to remove the "impurities" present in the fibre (glue lumps and coarse fibres). At the exit from the separator 40 the fibres are fed by pneumatic conveying 42 to a cyclone 44 feeding a forming machine 48 via a metering belt 46.

This type of plant produces good-quality panels, ie free from glue lumps which would limit their subsequent use (for example making them unsuitable for painting or for "cladding", ie covering with decorative paper glued to the panel). The mechanical characteristics of these panels fall within the relative regulations. However glue consumption is high (between 120 and 180 kg per $m^3$ of finished panel) because of the fact that the glue is injected at the blow-up valve 14. In this respect, the glue passes, together with the fibres, through the dryer 18 (which operates at high temperature), to hence undergo prepolymerization which reduces its effectiveness.

Even more penalizing for this method is the presence of formaldehyde (contained in the glue) in the gas discharged to atmosphere at 34 after leaving the drying cyclones 32. This means that scrubbers have to be used for this gas together with treatment devices for the resultant water, with consequent considerable plant and operating costs.

A traditional or resin-blending plant is shown schematically in FIG. 2 in which elements similar or identical to those of FIG. 1 are indicated by the same reference numeral plus 100. A grinder is again provided, fed with wood and steam as indicated by the arrow 112. The fibres obtained from the grinder 112, and mixed with the steam (relative humidity 100%), are conveyed through a blow-up valve 114 and along a line 116 to a dryer 118 similar to the dryer 18 of FIG. 1. Hot gas 126 and air 128 at ambient temperature are also fed to the dryer via a fan 122 and a line 124 to dry the fibres. The dried fibres are then conveyed via a line 130 to a bank of cyclones 132 in which the dry fibre is separated from the steam which develops during drying, this being discharged to atmosphere, as indicated by the arrow 134.

The fibres leaving the cyclones 132, and having a moisture content varying from 2 to 10%, are fed via a mechanical conveyor 136 to a bunker weigher 138 where they are weighed out, to be then conveyed to a gluing machine (also known as a resin-blending machine) 120. This gluing machine is essentially a horizontally positioned cylindrical chamber inside which there is a mixing member 223 consisting basically of a coaxial rotating shaft provided with radial paddles. Liquid glue is injected through nozzles into the chamber (as schematically indicated by the arrow 121), it being the task of the mixing member 223 to uniformly distribute the glue throughout the fibre mass. After passing through the entire gluing machine, the fibres are conveyed into a pneumatic separator 140 to separate the "impurities" present in the fibre. The fibre is then fed by pneumatic conveying 142 to a cyclone 144 feeding a forming machine 148 via a metering belt 146.

Compared with the preceding, this type of plant has the advantage of low glue consumption and low formaldehyde emission to the atmosphere. However the gluing machine 120 does not distribute the glue with sufficient uniformity throughout the fibre mass, so that this type of plant produces poor-quality panels with the formation of lumps and stains which drastically limit the use of the product obtained. In particular the panels produced cannot be painted or clad. Moreover because of the poor glue distribution, these panels do not present mechanical and engineering characteristics which remain constant with time and are uniform throughout the panel.

Italian patent 1274565, in the name of the present applicant, describes a gluing machine for wood fibre panel production by a dry process, which if used in a traditional plant enables the aforedescribed drawbacks to be overcome. This gluing machine comprises a horizontally positioned hollow cylindrical body, at one end of which there is provided an entry aperture for feeding an air stream which conveys the wood fibre mass within which the liquid glue is to be distributed, at the other end of the cylindrical body there being provided an exit aperture for outflow of the air stream conveying the glue-impregnated fibres. Sprayer means are also provided to spray with glue the fibre mass fed to the gluing machine. Means are also provided to maintain the fibres in proximity to the inner wall of the cylindrical body for a predetermined length as they flow through it. Said sprayer means are positioned coaxially along said length throughout which the fibres are maintained in proximity to the inner surface of the cylindrical body. The means for maintaining the fibres in proximity to said inner wall comprise a pipe having a downstream-facing open end which opens into the cylindrical body in the vicinity of the sprayer means, this pipe extending coaxially in the upstream direction from said end at least for a certain length before leaving the cylindrical body, an air stream being fed into the other end of this pipe.

This gluing machine can comprise a mixing member (for example a motorized shaft provided with paddles) arranged downstream of the position in which the fibres are struck by the jets of glue.

If used in a resin-blending plant in place of traditional gluing machines, the aforedescribed gluing machine enables wood fibre panels to be obtained of substantially better quality than those obtainable with traditional plants provided with a gluing machine. It has however the drawback that the lateral inner wall of the cylindrical body of the gluing machine is very easily fouled because the glue-impregnated fibres tend to adhere to it. This means that frequent plant shut-downs are required for cleaning said inner wall, with consequent serious repercussions on production costs.

OBJECTS AND SUMMARY OF THE INVENTION

The object of the invention is therefore to provide a gluing machine which while enabling optimum quality wood fibre panels (ie suitable for painting or cladding) to be obtained from the relative plant with low glue consumption and minimum formaldehyde emission, does not require frequent cleaning of the inner lateral surface of the gluing machine body.

This object is achieved by the gluing apparatus of the invention, comprising a tubular body and sprayer means to inject a suitable liquid glue into the interior of the tubular body, characterised in that the cross-section through the tubular body encloses an area which increases in progressing from its open upstream end, into which the wood fibres are fed conveyed by an air stream, to its open downstream end, the tubular body comprising a sealed outer wall and an air-permeable inner wall, in the outer wall of the tubular body there being provided a plurality of apertures distributed along this latter to enable additional air streams to be fed into it.

Said air-permeable inner wall is conveniently a wall (for example of steel) provided with a plurality of perforations having a substantially uniform distribution.

From tests carried out it has been found that the gluing apparatus of the invention does not present the drawback of fouling of its inner surfaces. even though it enables fibre panels of optimum quality to be obtained, using only a small quantity of glue, and with minimum release of formaldehyde into the atmosphere by the relative plant.

Said sprayer means are conveniently distributed along the tubular body at least throughout a portion of its length, starting from the downstream end. However coaxial sprayer means could also be used of the type described and illustrated in the aforestated patent 1274565.

BRIEF DESCRIPTION OF THE DRAWINGS

The invention will be more apparent from the ensuing description of one embodiment thereof and a relative plant. In this description reference is made to FIGS. 3–6 of the accompanying drawings, on which.

DETAILED DESCRIPTION OF THE INVENTION

Figure 3:
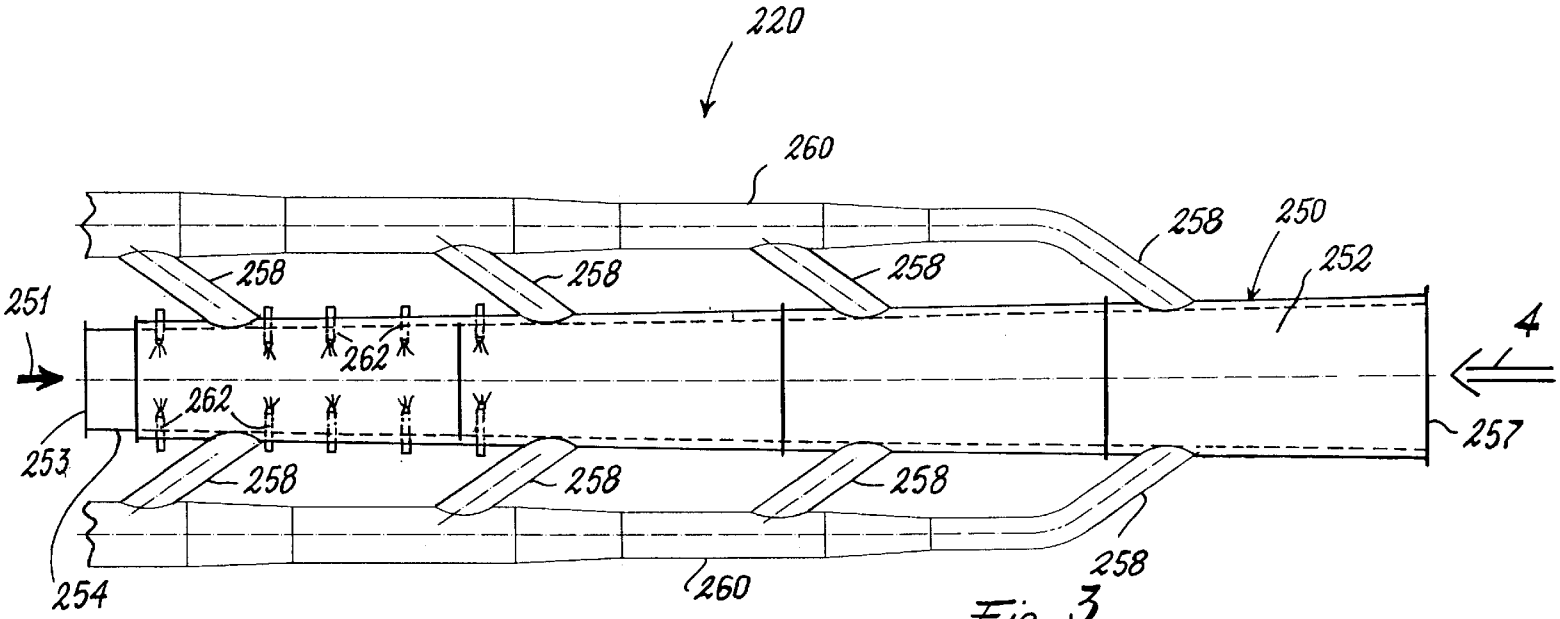
FIG. 3 is a side elevation of the gluing apparatus of the invention.
Figure 4:
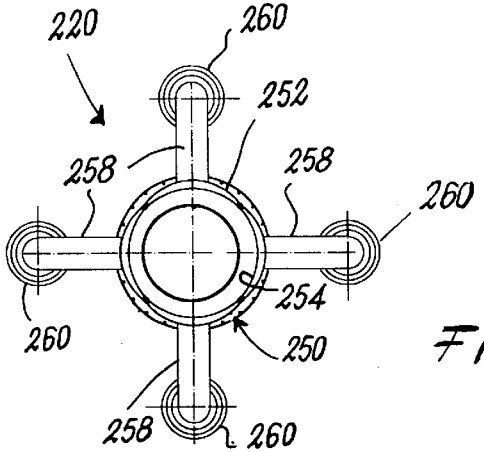
FIG. 4 is a view thereof in the direction of the arrow 4 of FIG. 3.

As can be seen from FIGS. 3 and 4, the gluing apparatus 220 comprises a tubular body 250 which, in this specific case, has an overall frusto-conical form for constructional simplicity. It can also be seen that the cross-section through the tubular body 250 encloses an area which increases from upstream to downstream, in which direction (indicated by the arrow 251) the wood fibres flow fed by an air stream to the upstream aperture 253 of the tubular body 250, to pass totally through it and leave through the downstream aperture 257.

Figure 5:
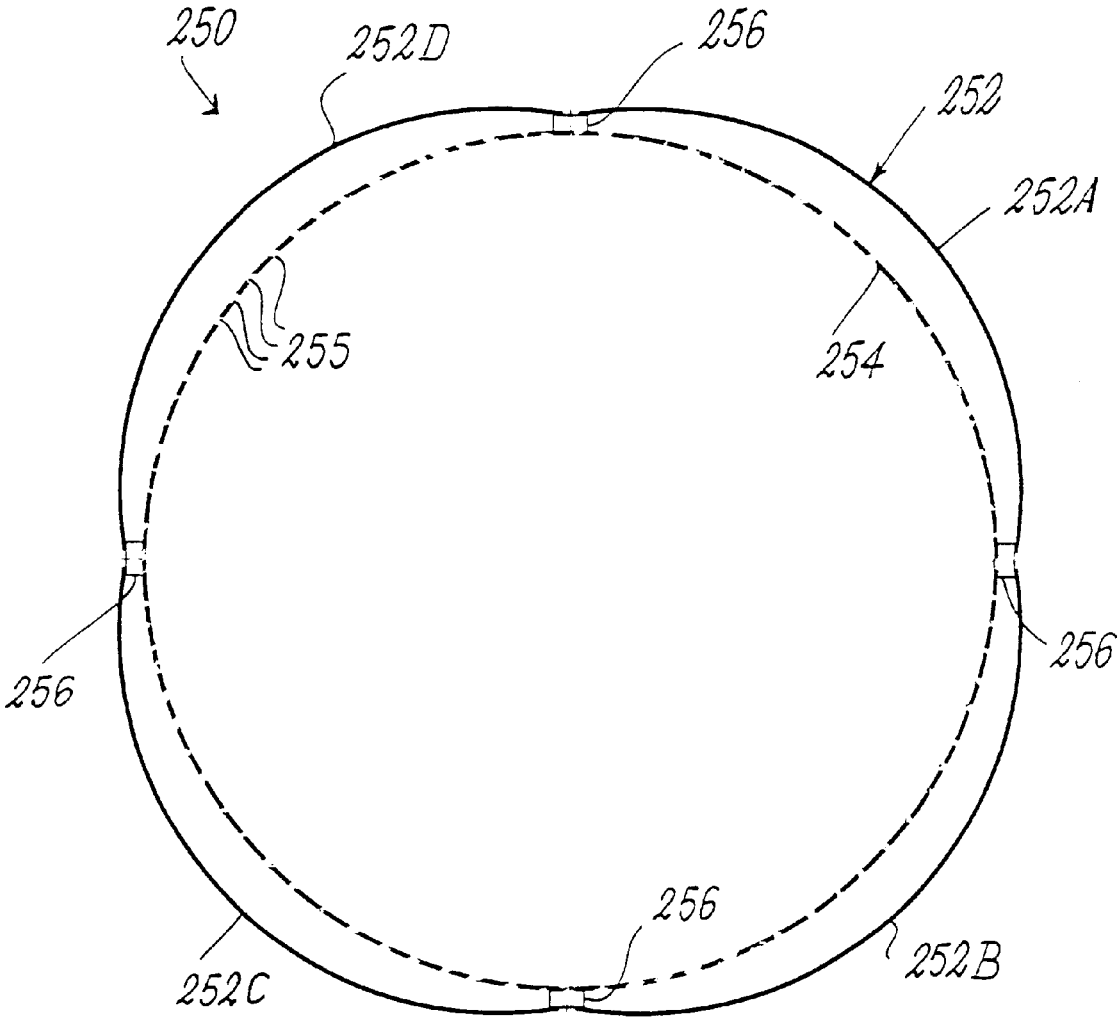
FIG. 5 is an enlarged generic cross-section through just the tubular body of the gluing apparatus.

As can be best seen from FIG. 5, the tubular body 250 is composed of a sealed outer wall, the profile of its cross-section being in the form of four just discernible lobes (252A, 252B, 252C, 252D), and an air-permeable inner wall 254 of circular cross-section. The inner wall 254 is formed in practice from plate perforated with a plurality of small holes 255 uniformly distributed in a fairly dense manner. The perforated inner wall 254 is supported by the outer wall 252 via spacers 256.

As can be seen from FIGS. 3 and 4, a plurality of tubes 258 inclined in the downstream direction are inserted into the outer wall 252 and are connected to relative manifolds 260 for feeding into the tubular body 250 relative additional air streams which open between the outer wall 252 and the perforated inner wall 254. The manifolds 260 are fed with a filtered air stream which becomes added to the air stream conveying the fibres fed to the entry aperture 254. As can be seen from FIG. 4, the tubes 258 are divided into four groups of four, each tube of each group being inserted into the outer wall in correspondence with a relative lobe (252A, 252B, 252C, 252D). Spray nozzles 262 distributed radially and longitudinally along the most upstream portion of the tubular body 250 are used to inject the liquid glue into this latter, the relative jets striking the fibre mass passing through the tubular body 250. In practice, the layer of air formed in proximity to the perforated inner wall 254 by the additional air streams fed through the tubes 258 prevents the liquid glue particles and the glue-impregnated fibres from coming into contact with the inner wall 254, which cannot therefore become fouled.

As already stated, the aforedescribed apparatus enables good glue distribution to be obtained throughout the wood fibre mass.

Figure 6:
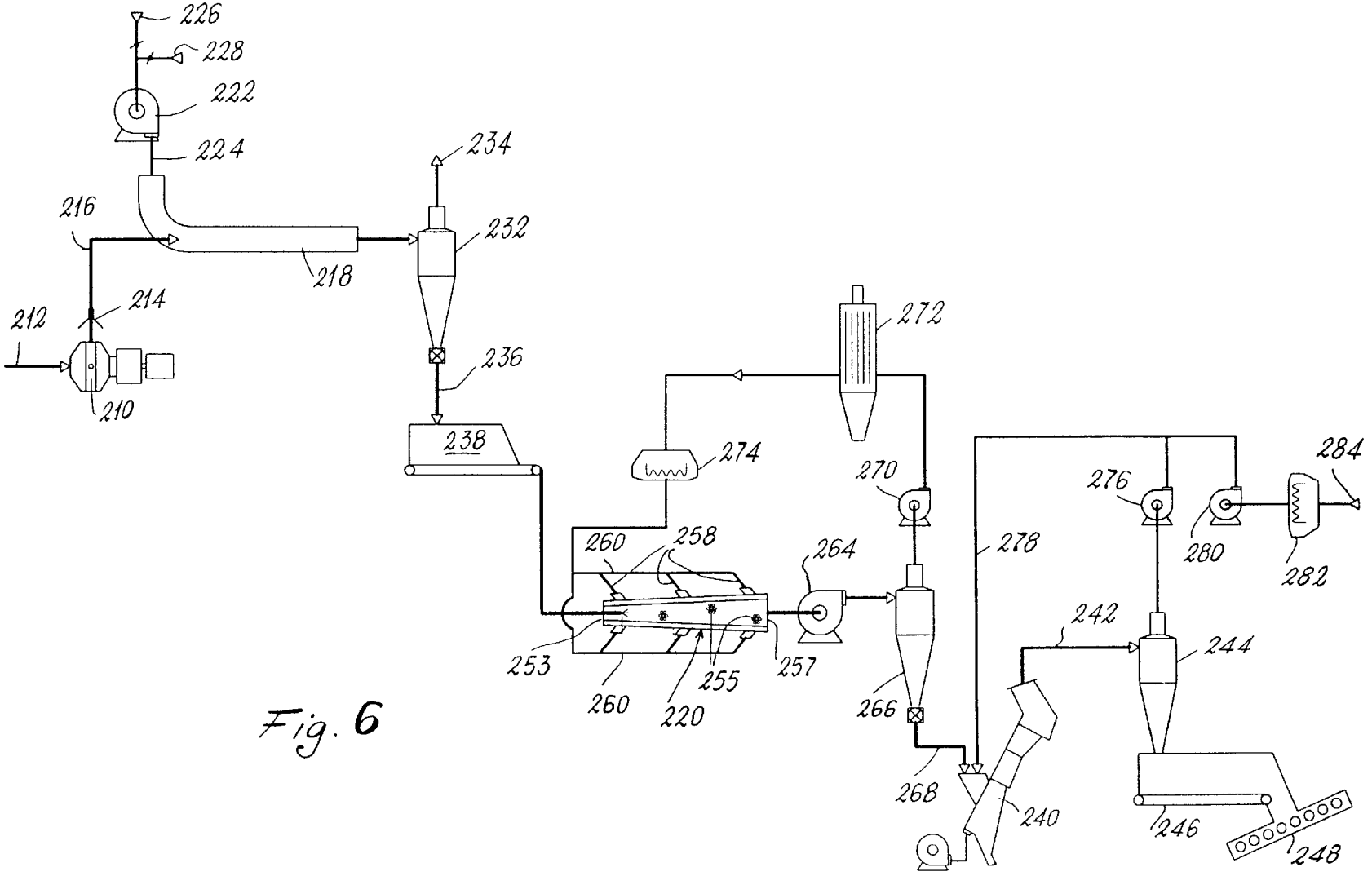
FIG. 6 is a scheme of a plant using the gluing apparatus of the invention.

A wood fibre panel production plant which includes the apparatus of the invention is shown in FIG. 6.

Figure 1:
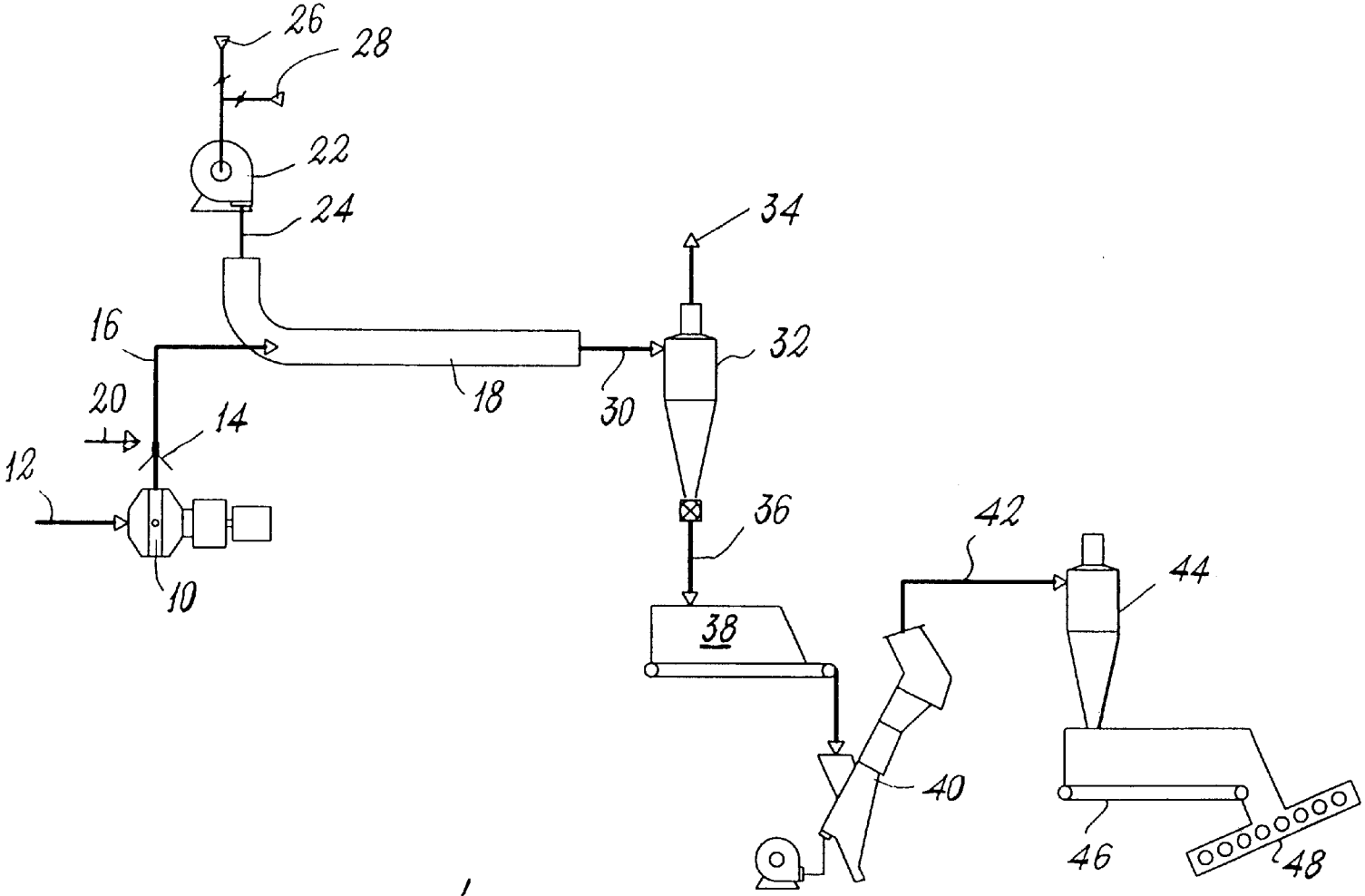
Fig. 1 (Prior Art)
Figure 2:
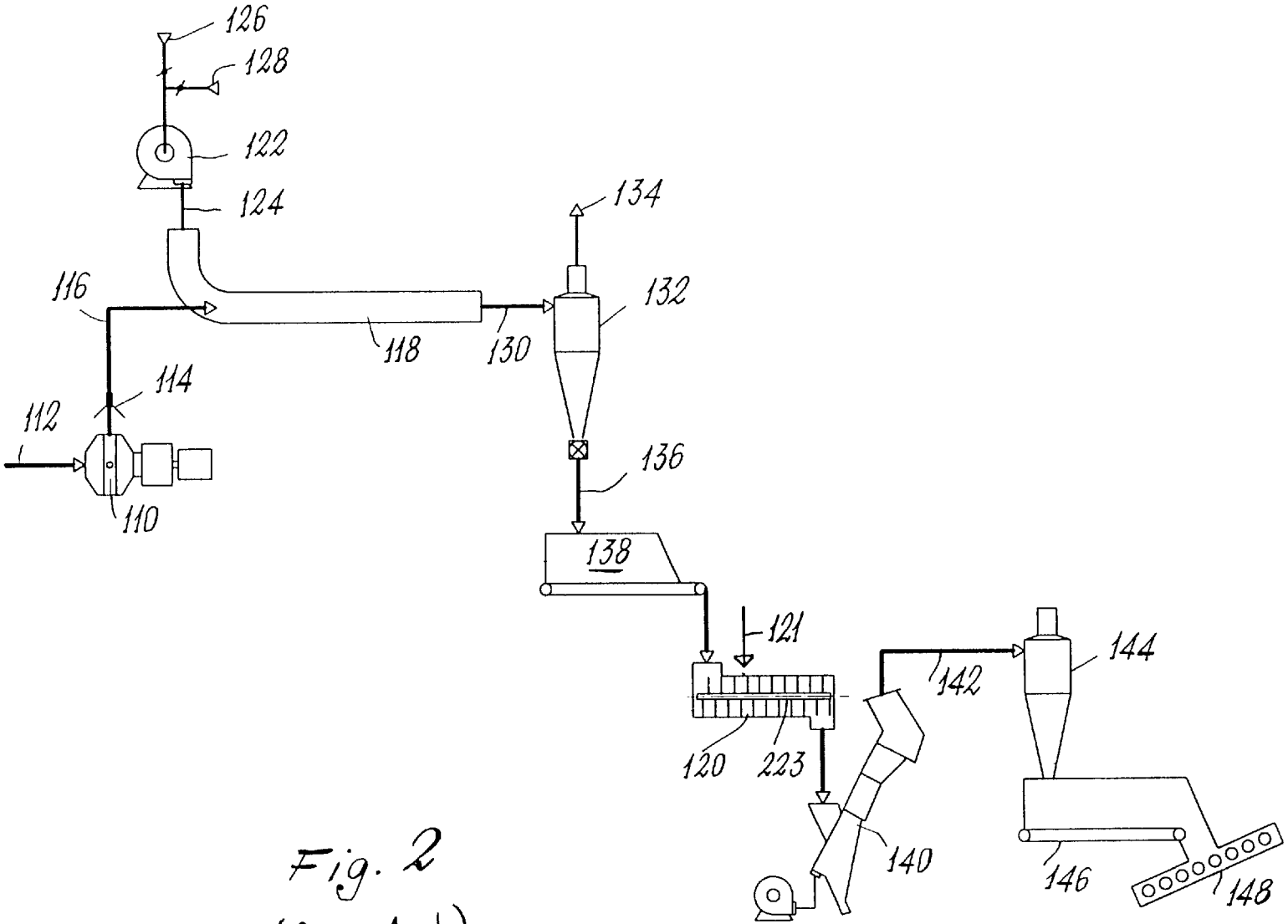
Fig. 2 (Prior Art)

The first part of the plant, as far as the gluing apparatus 220, is identical to that of FIG. 2 (the same reference numerals plus 100 have therefore been used) and will therefore not be described. The fibres leaving the weigher 238 are struck by a stream of air which conveys them pneumatically into the entry end 253 of the gluing apparatus 220 (shown very schematically in FIG. 6), which is therefore traversed throughout its entire length by the fibre and air stream. As already stated, during this passage the fibres are sprayed with the glue via nozzles 262 (FIG. 3) or other sprayer means (for example of the coaxial type, as in the gluing machine of the already cited patent 1274565). The fibre and glue mixture leaving the downstream end 257 of the gluing apparatus 220 is fed by a fan 264 into a cyclone 266, the purpose of which is to separate the fibres from the conveying air and from the air of the additional streams fed through the tubes 258. The fibres are then fed by pneumatic or mechanical conveying (indicated by the reference numeral 268) to a pneumatic separator 240 similar to that of the plants of FIGS. 1 and 2. The air leaving the cyclone 266 is injected into a filter 272 (for example a sleeve filter) by the fan 270. The clean air leaving the filter 272 is (if appropriate) heated by passing it through a heating bank 274 and used to feed the said additional air streams to the gluing apparatus 220 via the tubes 258.

With regard to the pneumatic separator 240, this has a double function. In this respect, not only does it separate the fibres from "foreign" bodies (coarse fibres and glue lumps), but being provided with independent heating means it is able to determine a uniform moisture content for the fibre-glue mixture, and provide it with a moisture content suitable for the subsequent pressing (not shown). The mixture leaving the separator 240 is fed by pneumatic conveying 242 to a cyclone 244 for loading the forming machine 248 which (as in the case of the plants of FIGS. 1 and 2) is located upstream of the pressing line.

If desired (and as shown in FIG. 6), the air separated by the cyclones 244 can be fed back into the separator 240 via a fan 276 and relative line 278. To this air there can be added air drawn from the outside (284) by a fan 280, and possibly heated by a radiation bank 282.

From the aforegoing it will be apparent that by using the gluing apparatus of the invention, the plant of FIG. 6 does not undergo fouling, and produces high quality wood fibre panels having constant mechanical characteristics with time, with a substantial reduction in the glue quantity used and in formaldehyde emission to the atmosphere.

What is claimed is:

1. A gluing apparatus (22) for plants for producing wood fibre panels by a dry method, comprising a tubular body (250) and sprayer means (262) to inject a suitable liquid glue into the interior of the tubular body (250), wherein a cross section of the tubular body defines an area which increases progressively from an open upstream end (253) of said tubular body, into which the wood fibres are fed conveyed by an air stream, to an open downstream end (257) of said tubular body, the tubular body (250) comprising an outer wall (252) and an air-permeable inner wall (254) spaced from the the outer wall (252), the outer wall (252) of the tubular body (250) having a plurality of apertures for enabling the introduction of additional air streams into said tubular body.

2. A gluing apparatus (220) as claimed in claim 1, wherein the inner wall (254) of the tubular body (250) is formed of perforated plate (255).

3. A gluing apparatus (220) as claimed in claim 1, wherein the sprayer means (262) are distributed along at least a portion of the length of the tubular body (250), starting from upstream.

4. A gluing apparatus (220) as claimed in claim 1, wherein the sprayer means are arranged coaxially.

5. A gluing apparatus (220) as claimed in claim 1, wherein the apertures for enabling the introduction of additional air streams into said tubular body are connected to tubes (258), said tubes having a portion closest to the tubular body (250) inclined in the downstream direction.

6. A gluing apparatus (220) as claimed in claim 1, wherein the outer wall (252) of the tubular body (250) has a cross-sectional profile which defines four lobes (252A, 252B, 252C, 252D), each one of the plurality of feed apertures for enabling the introduction of additional air streams being arranged at a center of a corresponding lobe.

7. A gluing apparatus (220) as claimed in claim 6, wherein the inner wall (254) of the tubular body has a cross-section profile which is circular.

8. A gluing apparatus for plants for producing wood fiber panels by a dry method, comprising:

a substantially tubular body having an open upstream end into which wood fibers are fed by an air stream and an open downstream end, the cross-sectional area of said tubular body increasing in the direction from the upstream end to the downstream end, said tubular body including sprayer means for injecting a suitable liquid glue into the interior of the tubular body;

an outer wall having a plurality of apertures; and an air-permeable inner wall spaced apart from said outer wall; and means for injecting air through the apertures in said outer wall.

9. The gluing apparatus as in claim 8, wherein the inner wall is formed of perforated plate.

10. The gluing apparatus as in claim 8, wherein said sprayer means are arranged along at least a portion of the length of the tubular body beginning proximate to the upstream end.

11. The gluing apparatus as in claim 8, wherein said sprayer means are arranged coaxially.

12. The gluing apparatus as in claim 8, wherein said means for injecting air through the apertures in said outer wall comprise tubes inserted within the apertures inclined in the downstream direction of said tubular body.

13. The gluing apparatus as in claim 8, wherein the cross-section of said outer wall comprises four lobes and wherein said means for injecting air through the apertures in said sealed outer wall are coupled to said lobes.

14. The gluing apparatus as in claim 8, wherein said inner wall has a substantially circular cross-section.

15. The gluing apparatus as in claim 12, further comprising a plurality of manifolds coupled to said tubes for providing air to said tubes.

* * * * *